US007415747B2

(12) United States Patent
Hamilton et al.

(10) Patent No.: US 7,415,747 B2
(45) Date of Patent: Aug. 26, 2008

(54) SURFACE CLEANING APPARATUS

(75) Inventors: Shiela Hamilton, Renfrewshire (GB); Charles Jonathan Kennett, Bridge of Weir (GB)

(73) Assignee: Teknek Holdings Limited, Renfrewshire (GB)

( * ) Notice: Subject to any disclaimer, the term of this patent is extended or adjusted under 35 U.S.C. 154(b) by 156 days.

(21) Appl. No.: 10/566,635

(22) PCT Filed: Jul. 28, 2004

(86) PCT No.: PCT/GB2004/003279

§ 371 (c)(1),
(2), (4) Date: Aug. 3, 2006

(87) PCT Pub. No.: WO2005/011883

PCT Pub. Date: Feb. 10, 2005

(65) Prior Publication Data

US 2007/0061983 A1 Mar. 22, 2007

(30) Foreign Application Priority Data

Jul. 28, 2003 (GB) ..... 0317532.0

(51) Int. Cl.

| | |
|---|---|
| ***A47L 1/02*** | (2006.01) |
| ***A47L 11/02*** | (2006.01) |
| ***G03D 5/06*** | (2006.01) |
| ***G03D 15/00*** | (2006.01) |

(52) U.S. Cl. ..... 15/3; 15/100; 15/102

(58) Field of Classification Search ..... 15/3, 15/100, 102, 256.52

See application file for complete search history.

(56) References Cited

U.S. PATENT DOCUMENTS

| | | | | |
|---|---|---|---|---|
| 5,349,714 | A * | 9/1994 | Korbonski et al. | 15/3 |
| 5,813,073 | A | 9/1998 | Korbonski | |
| 6,200,392 | B1 * | 3/2001 | Korbonski | 134/9 |
| 6,285,845 | B1 * | 9/2001 | Liatard et al. | 399/107 |

FOREIGN PATENT DOCUMENTS

| | | | |
|---|---|---|---|
| EP | 0 214 741 | | 3/1987 |
| EP | 214741 | A2 * | 3/1987 |

* cited by examiner

*Primary Examiner*—Joseph J. Hail, III
*Assistant Examiner*—Bryan R Muller
(74) *Attorney, Agent, or Firm*—Drinker, Biddle & Reath, LLP

(57) ABSTRACT

The invention relates to surface cleaning apparatus for removing contamination from sheet materials such as phototools and liquid crystal display (LCD) screens. The apparatus comprises a base unit having opposing walls for supporting a removable roller cartridge containing at least one cleaning roller and one adhesive roller. Progressive insertion of the roller cartridge into the base unit causes a camming mechanism provided on the base unit and the roller cartridge to interact so as to move the cleaning and adhesive rollers from a non-operatinig position in which the rollers are separated into an operating position in which the adhesive roller is brought into abutment with the cleaning roller. The apparatus is held in the operating position by a latching mechanism, for example, an electromagnet which may be selectively activated and deactivated simultaneously with activation and deactivation of a driving motor. The features of the invention ensure that the transferring of adhesive from the adhesive roller to the cleaning roller is automatically prevented when the rollers are stationary, even in the event of a power failure.

17 Claims, 9 Drawing Sheets

SURFACE CLEANING APPARATUS

BACKGROUND OF THE INVENTION

Field of the Invention

This invention relates to surface cleaning apparatus, and particularly, but not exclusively, to surface cleaning apparatus using a cleaning roller and an adhesive roller for removing contamination from sheet materials such as phototools and screens for LCD displays.

Apparatus of this type is well known, and makes use of a cleaning roller having a surface of relatively low tackiness in contact with an adhesive roller of relatively high tackiness. The workpiece is passed over the cleaning roller which picks up contaminants which are then transferred to and retained by the adhesive roller. Commonly, the workpiece is passed between two cleaning rollers, each with its own adhesive roller, to clean both sides of the workpiece simultaneously.

A problem with such apparatus is that, if the cleaning roller and the adhesive roller are left stationary and in contact with each other, "wetting" or transfer of adhesive from the adhesive roller to the cleaning roller will occur, which will have an adverse effect on the operation of the cleaning roller. This problem has previously been addressed in a number of ways.

The simplest provides a manually operable means such as a lever which the operator can use to separate the cleaning roller(s) from the adhesive roller(s). This requires only a simple mechanism, but there is a high probability of the operator using the system incorrectly. In particular, no fail-safe mechanism is provided to cause the adhesive roller(s) to separate from the cleaning roller(s) when they are stationary, for example, in the event of a power failure.

A common approach is to move the mounting of the adhesive roller by pneumatic cylinders. However, this requires the use of pneumatic cylinders and the provision of a compressed air supply and a suitable electro-pneumatic control system. This adds considerably to the cost and complexity of the apparatus.

It is also known to produce relative movement between cleaning roller(s) and adhesive roller(s) by means of solenoids or electromagnets, but arrangements for doing this have hitherto been mechanically cumbersome and have required relatively complex control circuitry.

A further feature of cleaning machines of this general type is that it is necessary from time to time to remove the cleaning rollers and the adhesive rollers, for example to perform extra cleaning on the cleaning rollers or to replace these, and to expose fresh areas of adhesive on the adhesive rollers or to replace these. It is known to mount the cleaning rollers and adhesive rollers in a removable cartridge, in an attempt to facilitate these operations. However, known cartridge systems are not provided with systems to avoid stationary contact between cleaning roller and adhesive roller.

SUMMARY OF THE INVENTION

According to the present invention there is provided surface cleaning apparatus for cleaning a sheet material comprising a base unit and a roller cartridge removably insertable into said base unit; said roller cartridge comprising a cleaning roller and a co-operating adhesive roller wherein the respective rollers are mounted for relative movement between (i) a first non-operating position in which the cleaning roller and adhesive roller are separated; and (ii) a second operating position in which the cleaning roller abuts against the adhesive roller; and wherein the base unit and the roller cartridge are each provided with formations adapted to interact to produce said relative movement as the roller cartridge is inserted into and removed from the base unit.

Preferably, the roller cartridge comprises a further opposed cleaning roller having a co-operating adhesive roller, the respective cleaning rollers being adapted for cleaning opposite surfaces of the sheet material.

Preferably, opposing walls extend from the base unit, said walls being adapted to receive and support opposing ends of the roller cartridge.

Preferably, at least one end of the roller cartridge is provided with a moveable plate comprising at least one cut-out portion, the or each cut-out portion defining a cartridge cam surface adapted to receive a bearing axle of an adhesive roller.

Preferably, the bearing axles are biased towards each other by a first resilient means.

Preferably, the moveable plate is slidably mounted for movement between a first position in which separation of the bearing axles is maximised and a second position in which the separation of the bearing axles is minimised; and wherein the moveable plate is biased towards said first position by a second resilient means.

Preferably, the interacting formations are respectively (i) at least one inclined slot formed in at least one wall of the base unit, the or each inclined slot defining a base unit cam surface; and (ii) at least one bearing member projecting from the or each moveable plate of the roller cartridge; the or each bearing member adapted to bear on its corresponding base unit cam surface.

Preferably, the or each base unit cam surface is adapted to move its corresponding bearing member against the bias of the second resilient means upon progressive insertion of the roller cartridge into the base unit.

Preferably, the or each cartridge cam surface allows the first resilient means to move the bearing axles towards their minimum separation upon movement of the moveable plate against the bias of the second resilient means.

Preferably, the roller cartridge is adapted to be inserted vertically into the base unit.

Alternatively, the roller cartridge is adapted to be inserted horizontally into the base unit.

Preferably, the longitudinal axis of the or each bearing member and the rotational axis of the or each adhesive roller are respectively parallel.

Alternatively, the longitudinal axis of the or each bearing member and the rotational axis of the or each adhesive roller are respectively perpendicular.

Preferably, the apparatus comprises a retaining means adapted to releasably retain the cleaning roller and the adhesive roller in the second operating position.

Preferably, the retaining means adapted to release the roller cartridge from its operating position in the event of a power failure.

Preferably, the retaining means comprises an electromagnet and a magnet.

Preferably, a driving motor is provided to power the apparatus and wherein the electromagnet is selectively activated upon activation of said driving motor.

Preferably, two inclined slots are provided in each wall of the base unit, said slots being laterally offset with respect to each other.

BRIEF DESCRIPTION OF THE DRAWINGS

Embodiments of the invention will now be described, by way of example only, with reference to the drawings, in which.

DETAILED DESCRIPTION OF THE PREFERRED EMBODIMENTS

FIGS. 1 to 7 show surface cleaning apparatus comprising a base unit 10 and a removable roller cartridge 12.

Figure 3:
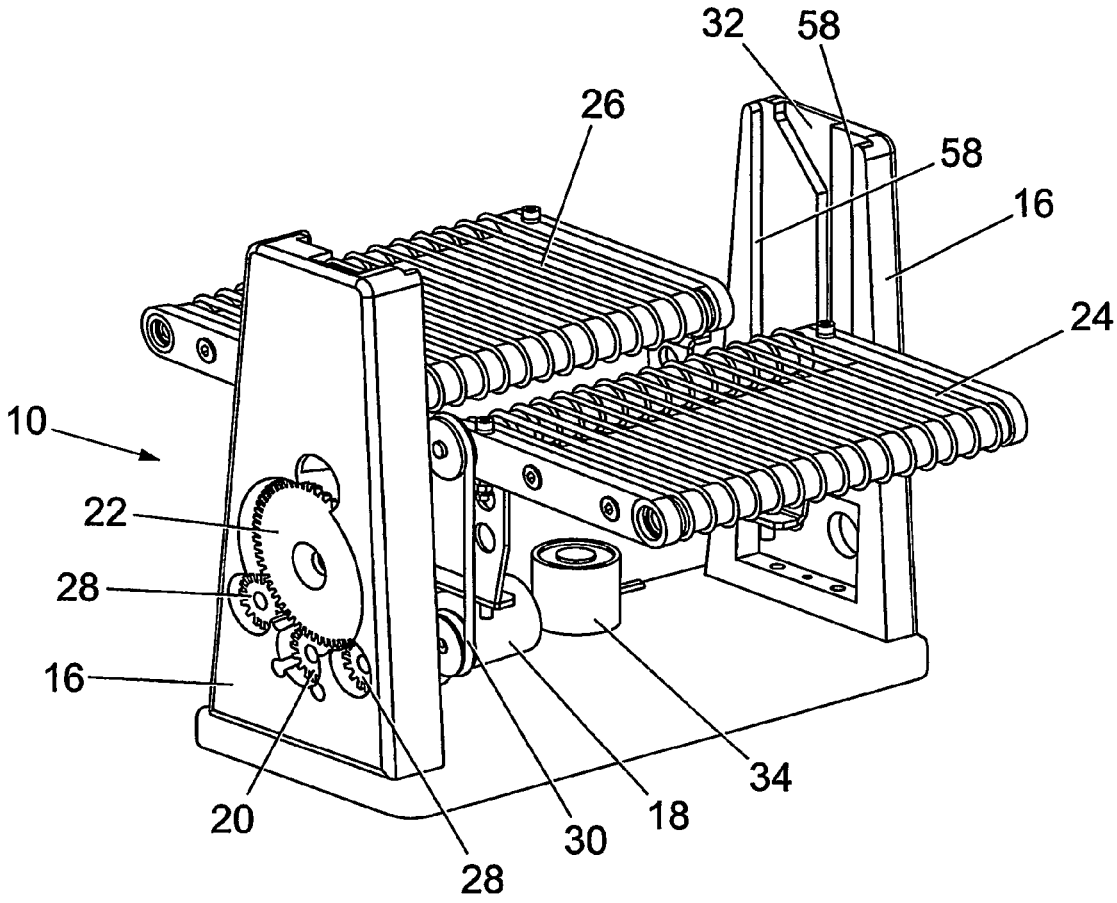
FIG. 3 is a similar view of the machine of FIG. 1 with a roller cartridge removed.
Figure 4:
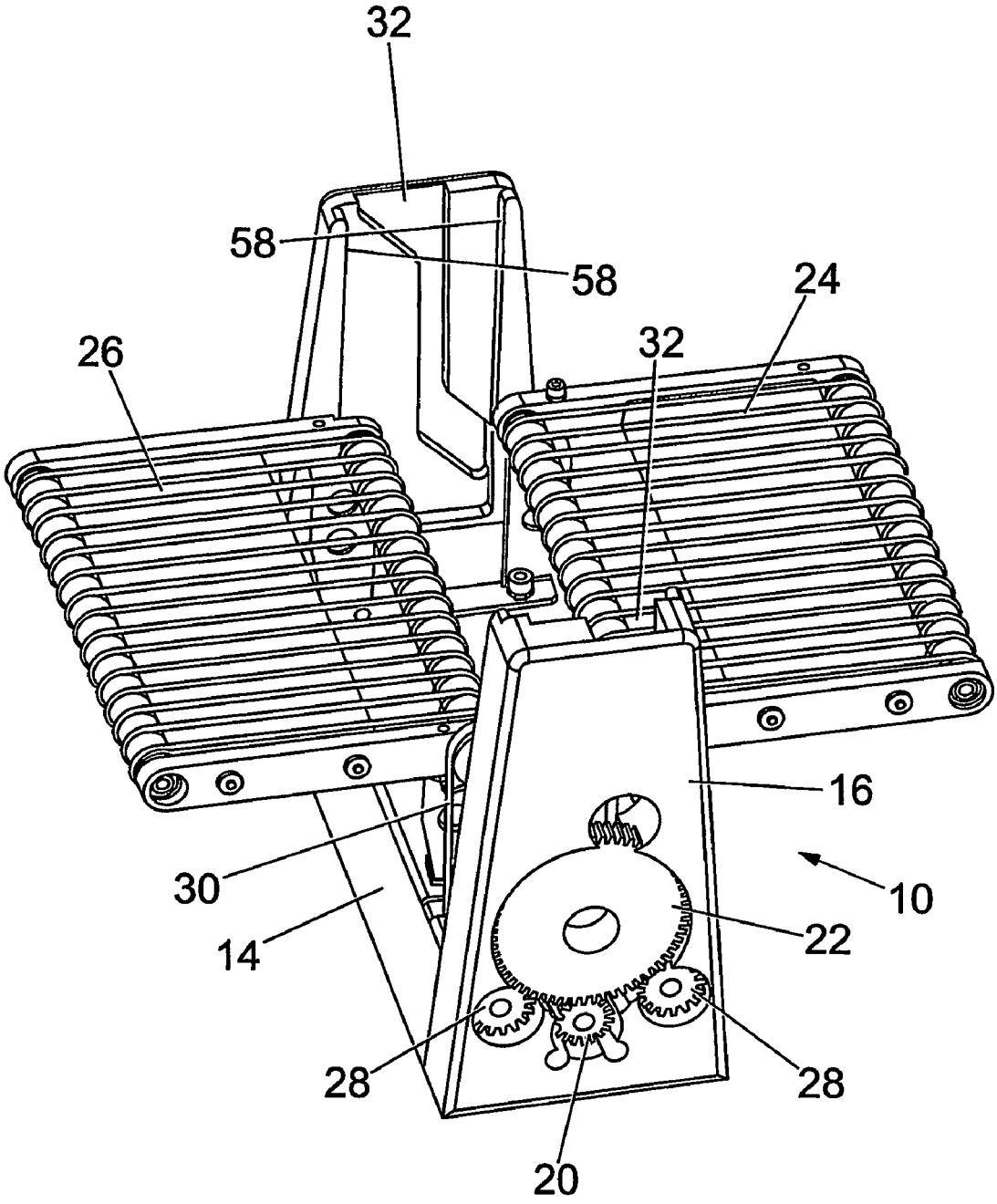
FIG. 4 is an isometric view corresponding to FIG. 3 but taken from another angle.
Figure 5:
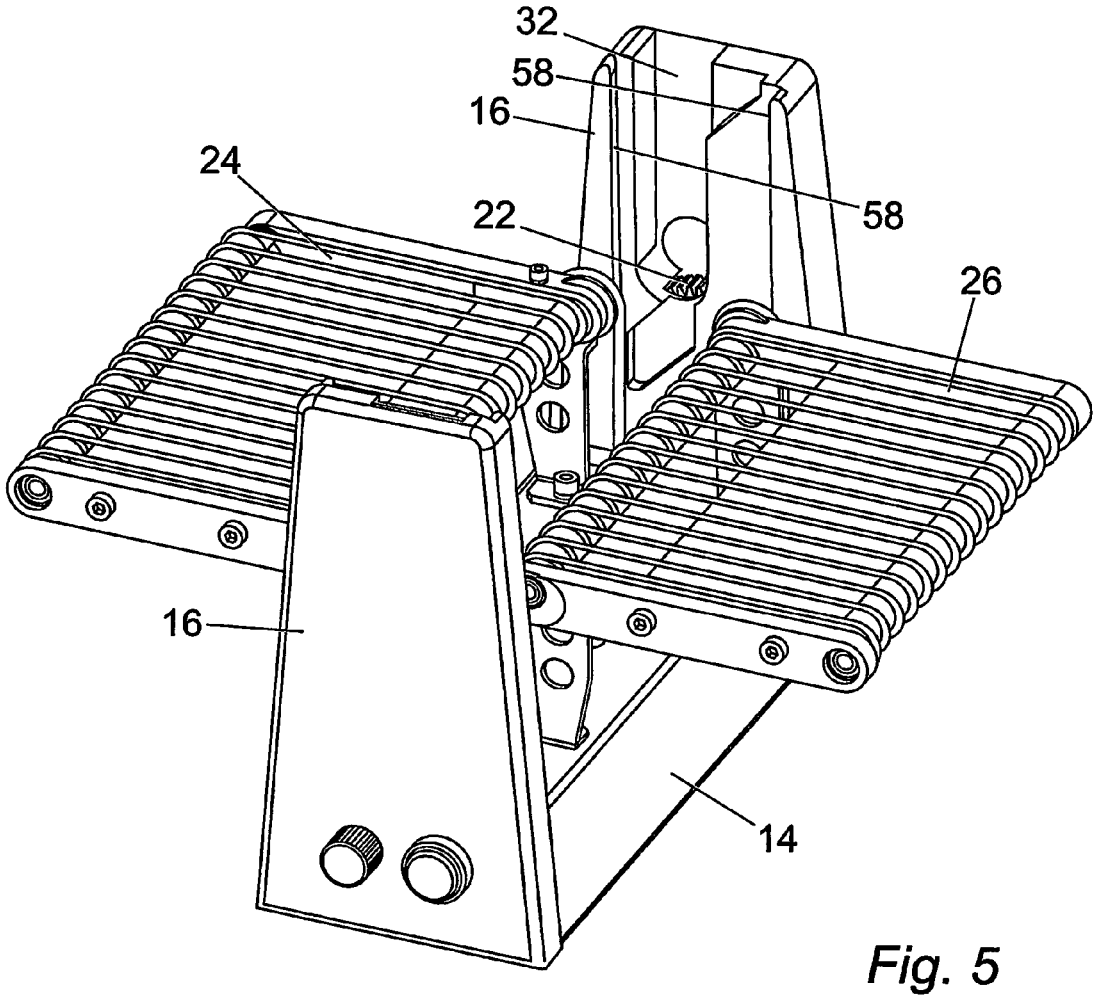
FIG. 5 is an isometric view corresponding to FIGS. 3 and 4 from the rear.

Referring particularly to FIGS. 3-5, the base unit 10 has a supporting portion 14 and upstanding opposing walls 16. An electric motor 18 (best seen in FIG. 3) drives a pinion 20 which in turn drives a drive gear 22. An in-feed conveyor 24 and an out-feed conveyor 26 are driven via pinions 28 and belts 30.

The drive gear 22 has the function of powering the roller assembly, as will be described below. It will also be noted from FIGS. 3-5 that inward faces of the opposing walls 16 are formed with inclined slots 32 which define base unit cam surfaces. An electromagnet 34 is secured to the supporting portion 14 of the base unit 10.

Figure 6:
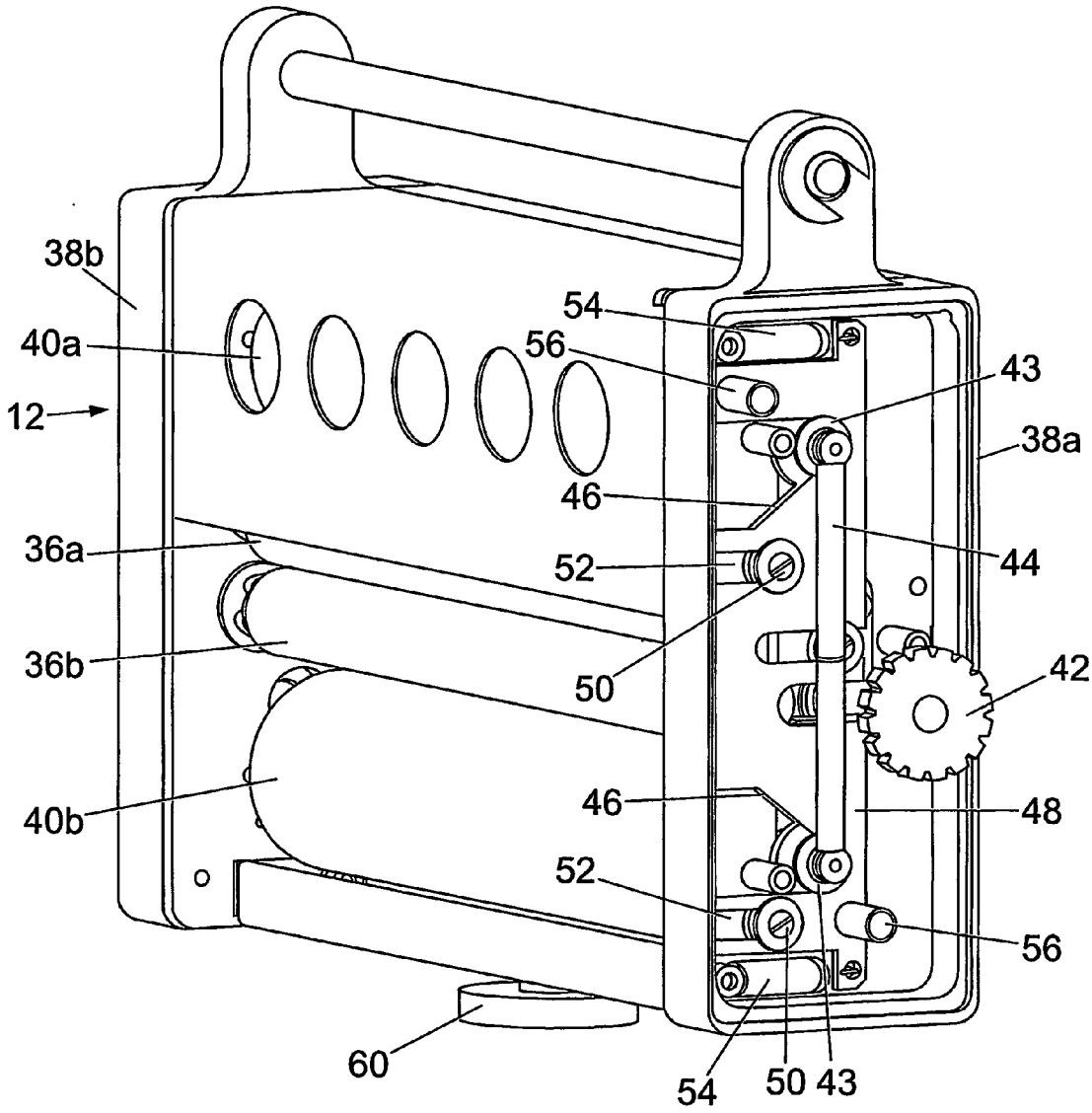
FIG. 6 is an isometric view of the roller cartridge in a non-operating condition.
Figure 7:
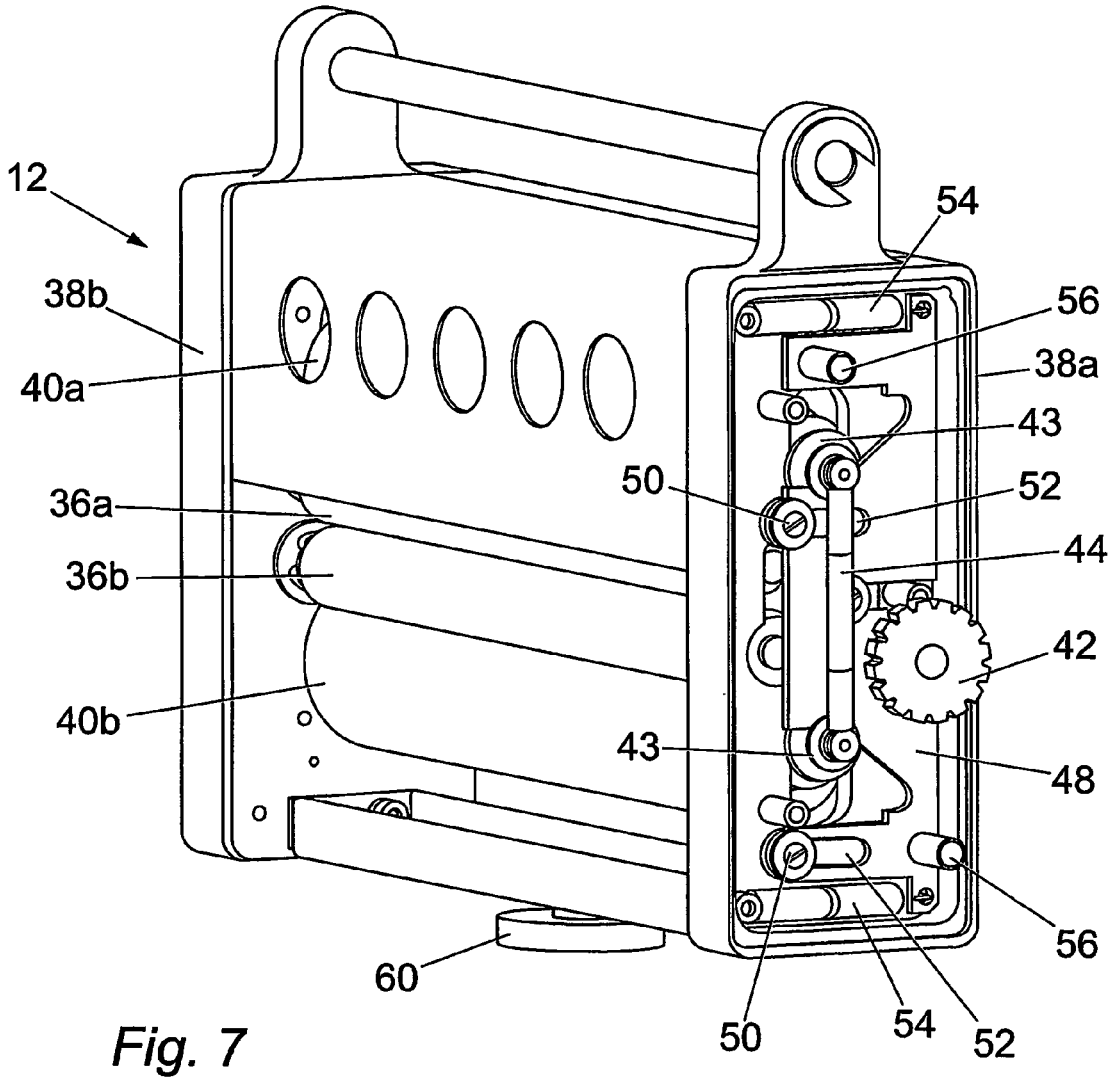
FIG. 7 is a view similar to FIG. 6 showing the cartridge in an operating condition.

Referring now particularly to FIGS. 6 and 7, the roller cartridge 12 includes a pair of cleaning rollers 36*a* and 36*b* journalled for rotation in side members 38*a* and 38*b* and biased together by resilient means (not shown) to form a resilient nip. When the roller cartridge 12 is in the operational position the cleaning rollers 36 are driven by the drive gear 22 by means of a pinion 42.

Each cleaning roller 36*a* and 36*b* is associated with a respective adhesive roller 40*a* and 40*b*. When the surface cleaning apparatus is in operation, each cleaning roller 36 is brought into contact with its adhesive roller 40 as seen in FIG. 7. Conversely, when the machine is not in operation each adhesive roller 40 is caused to move out of contact with its corresponding cleaning roller 36, as seen in FIG. 6. The nature of this operation will be further described below.

The axles of the adhesive rollers 40 are journalled in flanged wheels 43 and are biased together at their respective ends by means of tension springs 44, one of which is shown in FIGS. 6 and 7. The axles (hereinafter referred to as bearing axles) engage oblique cartridge cam surfaces 46-formed in moveable plates 48 each of which is slidably mounted on the respective side member 38 by means of pins 50 and slots 52. The moveable plates 48 are biased by tension springs 54 to the position seen in FIG. 6.

Each of the movable plates 48 is provided with a pair of spaced upstanding pins or rollers 56 which act as bearing members for engagement with the inclined slots 32 in the opposing walls 16 of the base unit 10.

In use, the roller cartridge 12 is inserted vertically into the base unit 10. The opposing walls 16 of the base unit 10 are formed with straight shoulders 58 (FIGS. 3 to 5) which act as guides for the side members 38 of the roller cartridge 12. The pins or rollers 56 define bearing members which bear against the inclined slots 32. Once inserted from the top, the roller cartridge 12 moves downwardly under the influence of gravity to the condition shown in FIGS. 2 and 6.

It will be appreciated that, during said downward motion, no resistive forces are imparted on the lowermost bearing members (i.e. pins or rollers) 56 by the vertical portions of the slots 32. However, once the lowermost bearing members 56 reach the bottom of the vertical portions of the slots 32, the inclined portions of the slots 32 prevent further downward motion. The roller cartridge 12 is maintained in the position shown in FIG. 2 because the spring force in tension springs 54 is sufficient to prevent both the uppermost and lowermost bearing members 56 from moving laterally and travelling down the inclined parts of inclined slots 32.

Figure 1:
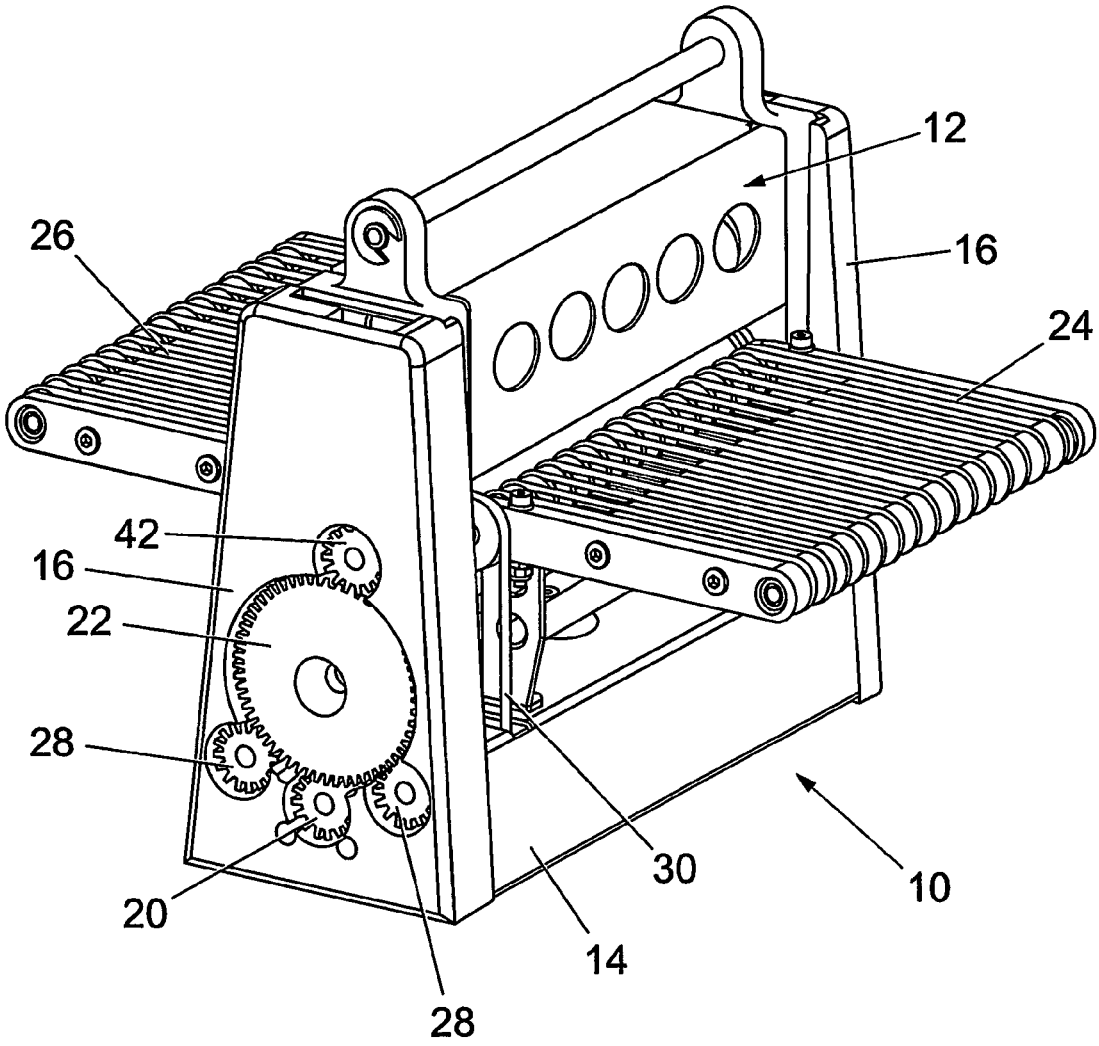
FIG. 1 is an isometric view of a cleaning machine forming one embodiment of the invention, in an operating condition.
Figure 2:
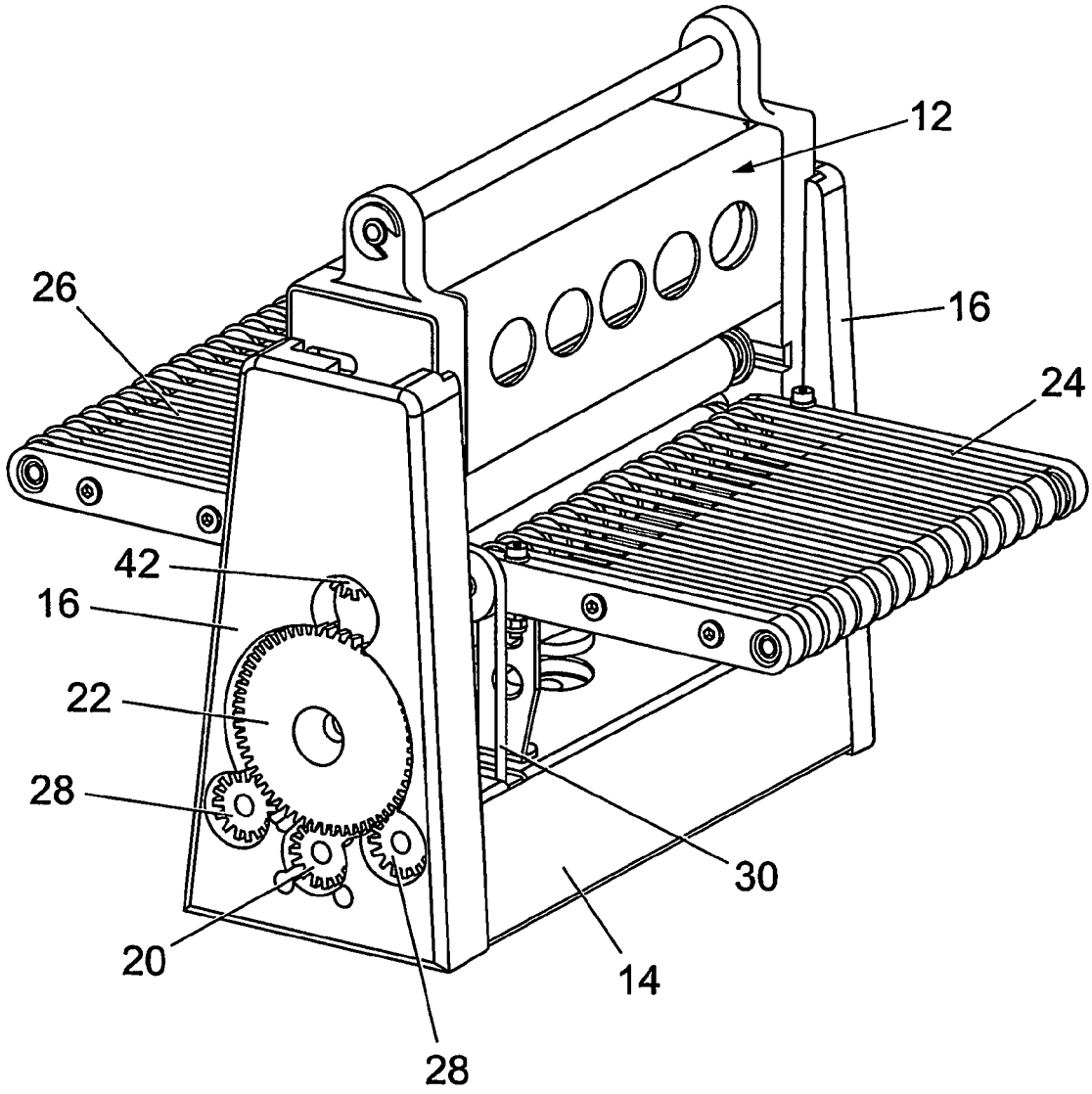
FIG. 2 is a similar view of the same machine in a non-operating condition.

By exerting manual downward pressure, a user can move the roller cartridge 12 to the position shown in FIG. 1. During this movement a camming action between the inclined slots 32 and the pins or rollers 56 brings the cartridge into the condition shown in FIG. 7 causing the cleaning rollers 36 to move into contact with their corresponding adhesive rollers 40.

The surface cleaning apparatus is maintained in this operational condition by means of an electromagnet 34 being activated to exert an attracting force on an armature magnet 60 secured to the underside of the cartridge 12. By connecting the electromagnet 34 in series with the driving motor 18, it can be ensured that whenever the driving motor 18 is deactivated, so also is the electromagnet 34 thus allowing tension springs 44 and 54 to return the apparatus to the condition of FIGS. 2 and 6. It will be appreciated by those skilled in the art that other forms of latching mechanism could be used.

The surface cleaning apparatus of the present invention thus provides a roller cartridge 12 which can be removed and replaced in a simple manner for maintenance or replacement of the rollers. The surface cleaning apparatus also provides a convenient and economical arrangement to ensure that the cleaning rollers 36 do not remain in contact with their adhesive rollers 40 when stationary, for example when the power supply fails.

Figure 8A:
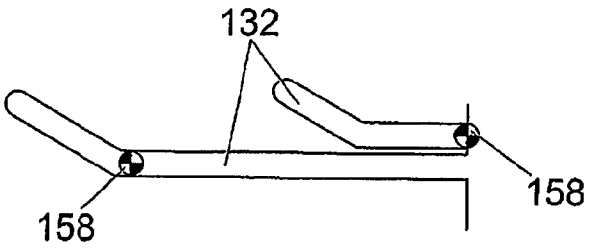
FIG. 8A is a detail of tracks in the machine of FIG. 8.
Figure 8:
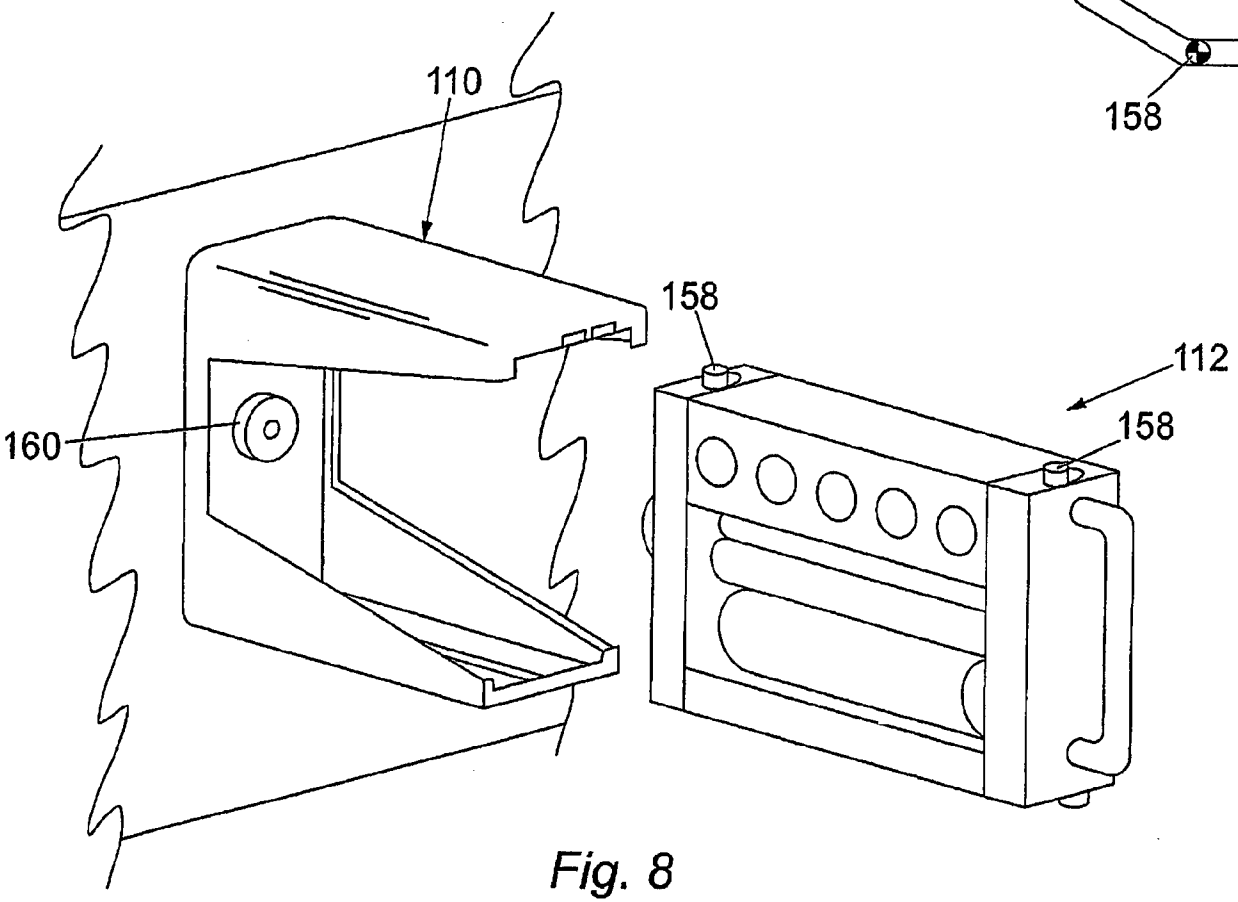
FIG. 8 is a perspective schematic view illustrating a second embodiment.

FIG. 8 shows an alternative and simplified embodiment, in which a substantially complete surface cleaning apparatus 112 is inserted sideways in a simple base unit 110. The apparatus 112 contains the required drive motor and a latching electromagnet, the armature magnet 160 being fixed to the base unit 110. FIG. 8*a* shows slots 132 which are laterally offset with respect to each other and are engaged by offset pins 158 on opposing sides of the apparatus 112.

Figure 9:
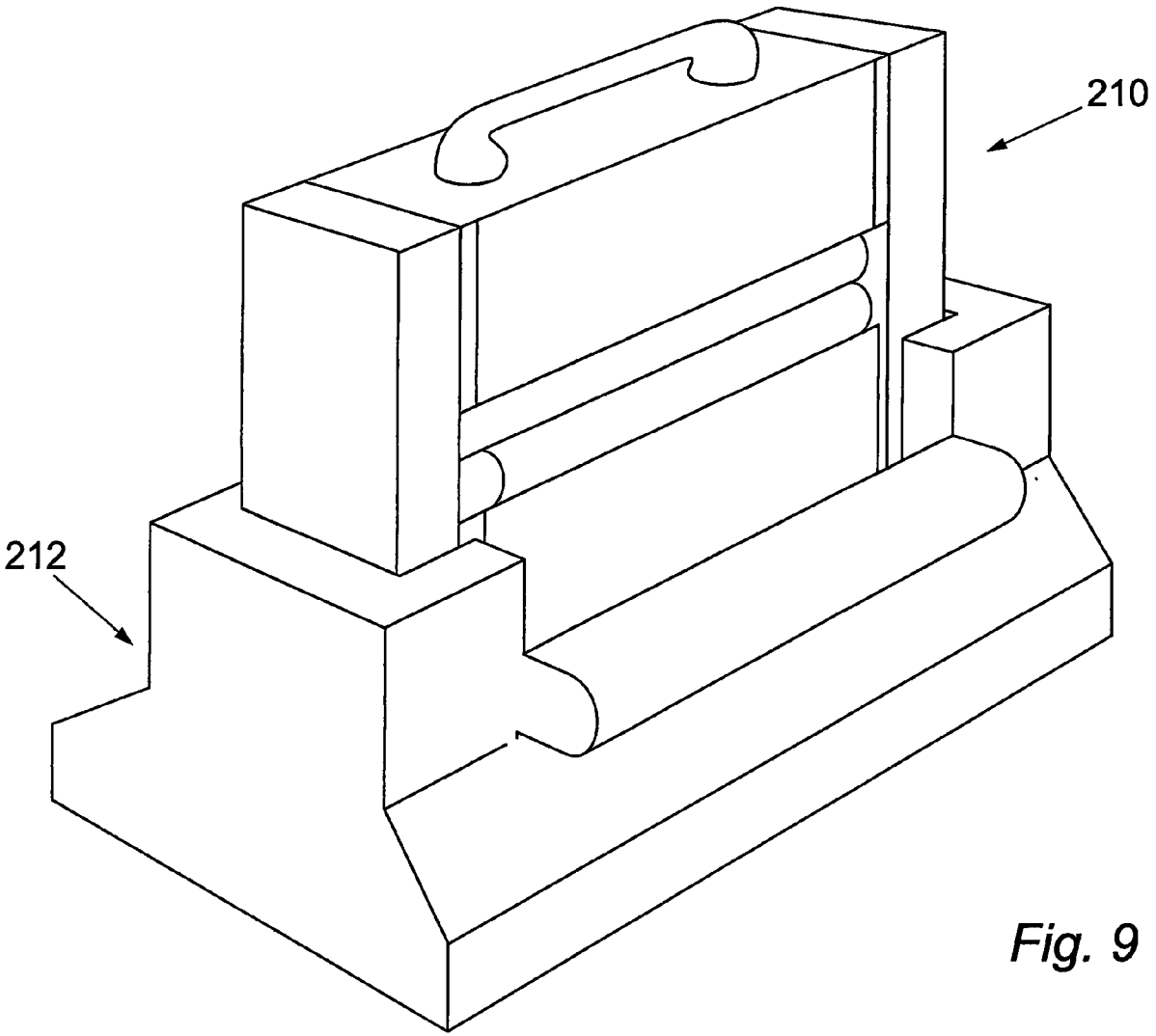
FIG. 9 is a perspective schematic view illustrating a further embodiment.

FIG. 9 shows a concept similar to that of FIG. 8, with a removable machine 212 being insertable in a simple base unit 210 suitable for desk-top use.

The preferred embodiments of the invention thus provide a surface cleaning apparatus which combines the convenience of a roller cartridge with a simple fail-safe means for avoiding stationary contact between the cleaning rollers and the adhesive rollers.

Modifications and improvements may be made to the foregoing embodiments without departing from the scope of the present invention. For example, whilst the apparatus is adapted to cause the adhesive rollers to move in a parallel manner with respect to the cleaning rollers, it would also be possible to separate and unite the rollers by means of a pivoting motion. This could be achieved by providing the interacting formations (i.e. the inclined slots and bearing members) at one side only whilst fixing the adhesive rollers in position at the other side.

Moreover, whilst two oblique cartridge cam surfaces 46 are formed in the moveable plates 48 in FIGS. 6 and 7, the invention could operate by fixing one of the bearing axles in position and employing only one oblique cartridge cam surface 46. In this way, relative movement of the adhesive rollers 40 would be achieved due to movement of the bearing axle of the other adhesive roller along the cam surface 46.

The invention claimed is:

1. A surface cleaning apparatus for cleaning a sheet material comprising a base unit and a roller cartridge removably insertable into said base unit, said roller cartridge comprising a cleaning roller and a co-operating adhesive roller wherein the respective rollers are mounted for relative movement between (i) a first non-operating position in which the cleaning roller and adhesive roller are separated; and (ii) a second operating position in which the cleaning roller abuts against the adhesive roller; and wherein at least one end of the roller cartridge is provided with a moveable plate comprising at least one cut-out portion, the at least one cut-out portion defining a cartridge cam surface adapted to receive a bearing axle of said adhesive roller; wherein a cam surface is provided on the base unit and a bearing member projects from the roller cartridge, such bearing member acting against the cam surface to produce said relative movement as the roller cartridge is inserted into and removed from the base unit.

2. The surface cleaning apparatus according to claim 1, wherein the roller cartridge comprises a further opposed cleaning roller having a co-operating adhesive roller, the respective cleaning rollers being adapted for cleaning opposite surfaces of the sheet material.

3. The surface cleaning apparatus according to claim 1, wherein opposing walls extend from the base unit. said walls being adapted to receive and support opposing ends of the roller cartridge.

4. The surface cleaning apparatus according to claim 1, wherein the bearing axles are biased towards each other by a first resilient means.

5. The surface cleaning apparatus according to claim 1, wherein the moveable plate is slidably mounted for movement between a first position in which separation of the bearing axles is maximised and a second position in which the separation of the bearing axles is minimized; and wherein the moveable plate is biased towards said first position by a second resilient means.

6. The surface cleaning apparatus according to claim 1, wherein the cam surface is defined by at least one inclined slot formed in at least one wall of the base unit.

7. The surface cleaning apparatus according to claim 6, wherein the at least, one base unit cam surface is adapted to move its corresponding bearing member against the bias of the second resilient means upon progressive insertion of the roller cartridge into the base unit.

8. The surface cleaning apparatus according to claim 7, the at least one cartridge cam surface allows the first resilient means to move the bearing axles towards their minimum separation upon movement of the moveable plate against the bias of the second resilient means.

9. The surface cleaning apparatus according to claim 1, wherein the roller cartridge is adapted to be inserted vertically into the base unit.

10. The surface cleaning apparatus according to claim 1, wherein the roller cartridge is adapted to be inserted horizontally into the base unit.

11. The surface cleaning apparatus according to claim 6, wherein the longitudinal axis of the or each bearing member and the rotational axis of the or each adhesive roller are respectively parallel.

12. The surface cleaning apparatus according to claim 6, wherein the longitudinal axis of the or each bearing member and the rotational axis of the or each adhesive roller are respectively perpendicular.

13. The surface cleaning apparatus according to claim 1 comprising a retaining means adapted to releasably retain the cleaning roller and the adhesive roller in the second operating position.

14. The surface cleaning apparatus according to claim 13, wherein the retaining means is adapted to release the roller cartridge from its operating position in the event of a power failure.

15. The surface cleaning apparatus according to claim 13, wherein the retaining means comprises an electromagnet and a magnet.

16. The surface cleaning apparatus according to claim 15, wherein a driving motor is provided to power the apparatus and wherein the electromagnet is selectively activated upon activation of said driving motor.

17. The surface cleaning apparatus according to claims 6, wherein two inclined slots are provided in each wall of the base unit, said slots being laterally offset with respect to each other.

* * * * *